US009777687B2

(12) United States Patent
Nakano

(10) Patent No.: US 9,777,687 B2
(45) Date of Patent: Oct. 3, 2017

(54) FUEL SUPPLY DEVICE AND FUEL SUPPLY METHOD FOR INTERNAL COMBUSTION ENGINE

(71) Applicant: TOYOTA JIDOSHA KABUSHIKI KAISHA, Toyota-shi (JP)

(72) Inventor: Tomohiro Nakano, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/096,823

(22) Filed: Apr. 12, 2016

(65) Prior Publication Data

US 2016/0298587 A1 Oct. 13, 2016

(30) Foreign Application Priority Data

Apr. 13, 2015 (JP) ..... 2015-082014

(51) Int. Cl.
*F02M 59/00* (2006.01)
*F02M 59/36* (2006.01)
(Continued)

(52) U.S. Cl.
CPC ..... *F02M 59/366* (2013.01); *F02D 41/08* (2013.01); *F02D 41/3845* (2013.01);
(Continued)

(58) Field of Classification Search
CPC .. F02M 59/366; F02M 59/027; F02M 59/466; F02M 51/04; F02M 61/08;
(Continued)

(56) References Cited

U.S. PATENT DOCUMENTS 6,314,945 B1 11/2001 Sugiyama et al.
7,552,720 B2 * 6/2009 Borg ..... F02M 59/366 123/506
(Continued)

FOREIGN PATENT DOCUMENTS

JP 03-149313 A 6/1991
JP 2001-041088 A 2/2001
(Continued)

*Primary Examiner* — Hieu T Vo
*Assistant Examiner* — Sherman Manley
(74) *Attorney, Agent, or Firm* — Oblon, McClelland, Maier & Neustadt, L.L.P.

(57) ABSTRACT

A fuel supply device includes an injector, a fuel pressurization device and an ECU. The fuel pressurization device includes an electromagnetic valve. The fuel pressurization device is configured to pressurize a fuel in accordance with opening/closing of the electromagnetic valve and discharge the fuel toward the injector. The ECU is configured: to control the opening/closing of the electromagnetic valve to adjust the fuel amount discharged toward the injector; to execute an operation sound suppression control during a low-load operation of an engine by reducing an opening/closing frequency of the electromagnetic valve and increasing the fuel amount discharged for each opening/closing of the electromagnetic valve; not to execute the operation sound suppression control when a partial lift injection is in progress; and to execute the operation sound suppression control when the partial lift injection is not in progress.

5 Claims, 6 Drawing Sheets

(51) Int. Cl.

| | |
|---|---|
| ***F02M 51/04*** | (2006.01) |
| ***F02M 59/02*** | (2006.01) |
| ***F02M 61/08*** | (2006.01) |
| ***F02M 63/02*** | (2006.01) |
| ***F02D 41/38*** | (2006.01) |
| ***F02D 41/08*** | (2006.01) |
| *F02M 59/46* | (2006.01) |

(52) U.S. Cl.
CPC ..... *F02M 51/04* (2013.01); *F02M 59/027* (2013.01); *F02M 61/08* (2013.01); *F02M 63/029* (2013.01); *F02D 2041/3881* (2013.01); *F02M 59/466* (2013.01); *F02M 2200/09* (2013.01)

(58) Field of Classification Search
CPC .. F02M 63/029; F02M 2200/09; F02D 41/08; F02D 41/3845; F02D 2041/3881
See application file for complete search history.

(56) References Cited

U.S. PATENT DOCUMENTS

| | | | | |
|---|---|---|---|---|
| 8,677,977 | B2 * | 3/2014 | Furuhashi | F02D 41/08 123/501 |
| 2006/0065243 | A1 | 3/2006 | Inoue et al. | |
| 2006/0118089 | A1 * | 6/2006 | Tokuo | F02D 41/3845 123/458 |
| 2007/0006849 | A1 * | 1/2007 | Mashiki | F02D 41/406 123/457 |
| 2014/0003966 | A1 | 1/2014 | Zen et al. | |
| 2014/0099215 | A1 * | 4/2014 | Kawano | F02M 59/368 417/279 |

FOREIGN PATENT DOCUMENTS

| | | | |
|---|---|---|---|
| JP | 2002-213326 | | 7/2002 |
| JP | 2002-317736 | A | 10/2002 |
| JP | 2006-090222 | A | 4/2006 |
| JP | 2013-234679 | A | 11/2013 |

* cited by examiner

FUEL SUPPLY DEVICE AND FUEL SUPPLY METHOD FOR INTERNAL COMBUSTION ENGINE

INCORPORATION BY REFERENCE

The disclosure of Japanese Patent Application No. 2015-082014 filed on Apr. 13, 2015 including the specification, drawings and abstract is incorporated herein by reference in its entirety.

BACKGROUND OF THE INVENTION

1. Field of the Invention

This disclosure relates to a fuel supply device and a fuel supply method for an internal combustion engine that is provided with a high-pressure fuel pump which pressurizes a fuel pumped from a fuel tank and supplies the fuel to a fuel injection valve.

2. Description of Related Art

A high-pressure fuel pump is disposed in an internal combustion engine such as an in-cylinder injection-type internal combustion engine. The high-pressure fuel pump pressurizes a fuel pumped from a fuel tank and supplies the fuel to a fuel injection valve. An electromagnetic valve is disposed in the high-pressure fuel pump. The amount of the fuel that is discharged from the high-pressure fuel pump is adjusted by opening and closing of the electromagnetic valve being controlled.

While the high-pressure fuel pump is in operation, an operation sound is generated as a result of the opening and closing of the electromagnetic valve. During a low-load operation when an overall sound that is generated by the internal combustion engine is not loud, the operation sound of the electromagnetic valve may stand out. Japanese Patent Application Publication No. 2002-213326 discloses a fuel supply device for an internal combustion engine that performs an operation sound suppression control for suppressing an operation frequency of the electromagnetic valves of the high-pressure fuel pumps as a whole, that is, suppressing the electromagnetic valve operation sound by increasing the fuel discharge amount for each opening and closing of the electromagnetic valve of one of the two high-pressure fuel pumps and then stopping a pressurizing operation of the other during a low-load operation with a small required fuel amount.

SUMMARY OF THE INVENTION

A partial lift injection is known as a technique for realizing high-accuracy micro injection. During the partial lift injection, the fuel injection is performed such that the injection is terminated before a valve body of the fuel injection valve reaches full opening. The valve body of the fuel injection valve performs a bounce motion because of a collision at a time of reaching the full opening, and the bounce motion causes an increase in fuel injection quantity variation. In this regard, during the partial lift injection, the fuel injection is performed without the bounce motion of the valve body being entailed. Accordingly, a trace amount of the fuel can be injected with a high level of accuracy.

The opening speed of the valve body of the fuel injection valve is changed depending on a fuel pressure level. Accordingly, during the partial lift injection, a change in injection quantity with respect to the fuel pressure increases. When the operation sound suppression control described above is performed, the fuel discharge amount of the high-pressure fuel pump per opening and closing of the electromagnetic valve increases and the fuel pressure has an increasing amount of pulsation. Accordingly, when the operation sound suppression control is carried out while the partial lift injection is in progress, the injection quantity variation of the partial lift injection increases and combustion of the internal combustion engine might deteriorate.

The disclosure provides a fuel supply device and a fuel supply method for an internal combustion engine with which a deterioration of combustion of an internal combustion engine can be suppressed and an operation sound of an electromagnetic valve can be suppressed.

An example aspect of the disclosure provides a fuel supply device for an internal combustion engine, the fuel supply device includes a fuel injection valve, a fuel pressurization device, an electronic control unit. The fuel pressurization device includes an electromagnetic valve. The fuel pressurization device is configured to pressurize a fuel in accordance with opening and closing of the electromagnetic valve and discharge the fuel toward the fuel injection valve. The electronic control unit is configured: to control the opening and closing of the electromagnetic valve such that the amount of the fuel discharged toward the fuel injection valve by the fuel pressurization device is adjusted; to execute an operation sound suppression control during a low-load operation of the internal combustion engine, the operation sound suppression control is a control for reducing an opening and closing frequency of the electromagnetic valve and increasing the amount of the fuel discharged by the fuel pressurization device for each opening and closing of the electromagnetic valve; not to execute the operation sound suppression control when a partial lift injection is in progress, the partial lift injection is injection for terminating the fuel injection before a valve body of the fuel injection valve reaches full opening; and to execute the operation sound suppression control when the partial lift injection is not in progress.

According to the configuration, when the operation sound suppression control is carried out, the opening and closing frequency of the electromagnetic valve is reduced, and thus an operation sound of the electromagnetic valve is suppressed. When the operation sound suppression control is carried out, the amount of the fuel discharged by the fuel pressurization device for each opening and closing of the electromagnetic valve increases. Accordingly, the pulsation of the pressure (fuel pressure) of the fuel that is sent to the fuel injection valve increases. In addition, when the partial lift injection is carried out, injection quantity accuracy significantly changes with respect to the fuel pressure. According to the configuration described above, the operation sound suppression control that leads to an increase in the fuel pressure pulsation is carried out when the partial lift injection is not in progress. Accordingly, a combustion deterioration and the operation sound of the electromagnetic valve can be suppressed at the same time.

In the fuel supply device, the fuel pressurization device may include a plurality of high-pressure fuel pumps, each of the plurality of high-pressure fuel pumps has the electromagnetic valve respectively, and the electronic control unit may be configured to execute the operation sound suppression control by controlling the opening and closing of the electromagnetic valves of the high-pressure fuel pumps such that a part of a pressurizing operation of the high-pressure fuel pumps is stopped. The fuel supply device may further includes a first high-pressure fuel pipe, a second high-pressure fuel pipe, and a connecting pipe. The connecting pipe may connect the first high-pressure fuel pipe and the second high-pressure fuel pipe. The internal combustion engine may include a first bank and a second bank. The plurality of high-pressure fuel pumps may include a first high-pressure fuel pump and a second high-pressure fuel pump, each of the first high-pressure fuel pump and the second high-pressure fuel pump having the electromagnetic valve. The first high-pressure fuel pump may be configured to supply the fuel to the fuel injection valve disposed in the first bank via the first high-pressure fuel pipe. The second high-pressure fuel pump may be configured to supply the fuel to the fuel injection valve disposed in the second bank via the second high-pressure fuel pipe. The electronic control unit may be configured to execute the operation sound suppression control such that the pressurizing operation of either the first high-pressure fuel pump or the second high-pressure fuel pump is stopped. In the fuel supply device, the fuel pressurization device may include a high-pressure fuel pump, the high-pressure fuel pumps has the electromagnetic valve, and the electronic control unit may be configured to execute the operation sound suppression control by controlling the opening and closing of the electromagnetic valve such that pressurizing operations of the high-pressure fuel pump is intermittently executed.

Another example aspect of the disclosure provides a fuel supply method for an internal combustion engine, the internal combustion engine includes a fuel pressurization device and a fuel injection valve. The fuel pressurization device includes an electromagnetic valve. The fuel pressurization device is configured to pressurize a fuel in accordance with opening and closing of the electromagnetic valve and discharge the fuel toward the fuel injection valve. The fuel supply method includes: controlling the opening and closing of the electromagnetic valve such that the amount of the fuel discharged toward the fuel injection valve by the fuel pressurization device is adjusted; executing an operation sound suppression control during a low-load operation of the internal combustion engine, the operation sound suppression control is a control for reducing an opening and closing frequency of the electromagnetic valve and increasing the amount of the fuel discharged by the fuel pressurization device for each opening and closing of the electromagnetic valve; not executing the operation sound suppression control when a partial lift injection is in progress, the partial lift injection is injection for terminating the fuel injection before a valve body of the fuel injection valve reaches full opening; and executing the operation sound suppression control when the partial lift injection is not in progress.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, a first embodiment of a fuel supply device for an internal combustion engine will be described in detail with reference to FIGS. 1 to 7.

Figure 1:
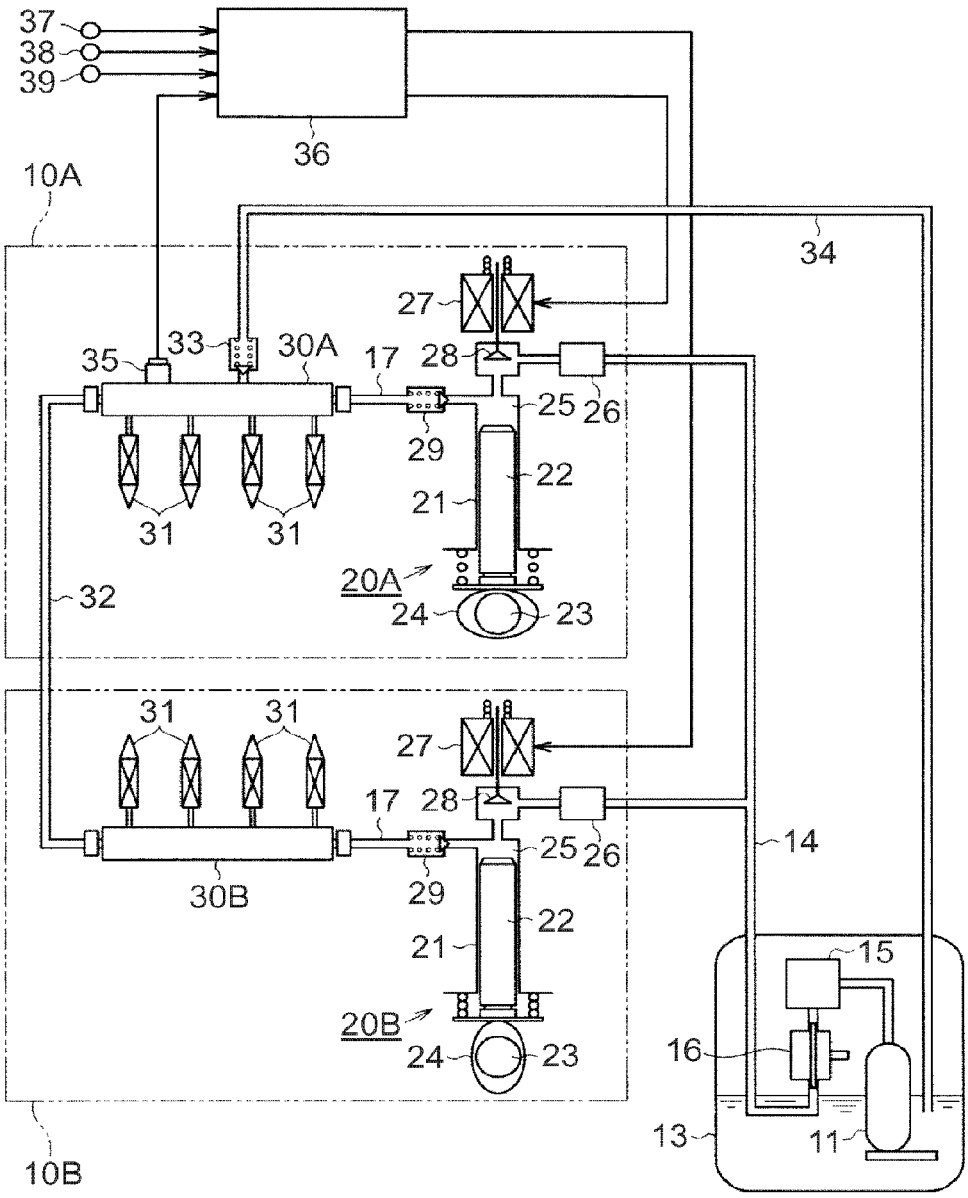
FIG. 1 is a schematic diagram illustrating an overall structure of a fuel supply device for an internal combustion engine according to a first embodiment.

As illustrated in FIG. 1, the internal combustion engine to which the fuel supply device according to this embodiment is applied is a V-type eight-cylinder internal combustion engine that has two banks, one being a first bank 10A and the other being a second bank 10B, and is provided with four cylinders in each of the banks.

The fuel supply device according to this embodiment is provided with a feed pump 11 and two high-pressure fuel pumps 20A, 20B that are disposed in the first bank 10A and the second bank 10B, respectively. The feed pump 11 pumps a fuel in a fuel tank 13 and sends the fuel to both the high-pressure fuel pumps 20A, 20B through a low-pressure fuel passage 14. A filter 15 and a pressure regulator 16 are disposed on the low-pressure fuel passage 14. The filter 15 filters impurities in the fuel. The pressure regulator 16 returns the fuel in the low-pressure fuel passage 14 to the fuel tank 13 when the pressure (feed pressure) of the fuel flowing through the low-pressure fuel passage 14 is excessive. The low-pressure fuel passage 14 branches into two passages in the middle to be connected to the two high-pressure fuel pumps 20A, 20B.

Each of the high-pressure fuel pumps 20A, 20B is provided with a cylinder 21, a plunger 22, and a pressurizing chamber 25. The plunger 22 is slidably disposed in the cylinder 21. The pressurizing chamber 25 is formed in the cylinder 21 to be partitioned by the plunger 22. The respective plungers 22 of the high-pressure fuel pumps 20A, 20B reciprocate in the cylinders 21 in response to rotation of cams 24 that are disposed in respective camshafts 23 of the banks 10A, 10B, and this allows the plunger 22 to change the volume of the pressurizing chamber 25. For the fuel supply device according to this embodiment, a cam that has two cam noses at 180° intervals about an axis of rotation of the camshaft 23 is employed as the cam 24 driving the plunger 22. The camshaft 23 rotates once for each cycle of the internal combustion engine, that is, for every two crankshaft rotations. Accordingly, the plunger 22 reciprocates four times for each cycle of the internal combustion engine. The cam nose that is disposed in the cam 24 of the high-pressure fuel pump 20B of the second bank 10B has a phase difference of 90° with respect to the cam nose of the cam 24 of the high-pressure fuel pump 20A of the first bank 10A. Accordingly, the high-pressure fuel pumps 20A, 20B of the two banks alternately reciprocate at 45° crank angle (CA) intervals.

The pressurizing chambers 25 of the high-pressure fuel pumps 20A, 20B are connected to the low-pressure fuel passage 14 via pulsation dampers 26 that suppress a fuel pressure pulsation. The pressurizing chambers 25 are connected to respective high-pressure fuel pipes 30A, 30B of the banks (10A, 10B) via high-pressure fuel passages 17. In addition, electromagnetic valves 28 and check valves 29 are disposed in the high-pressure fuel pumps 20A, 20B. The electromagnetic valve 28 is a normally open valve that is closed in response to energization of a built-in electromagnetic solenoid 27. When the electromagnetic valve 28 is open, the electromagnetic valve 28 allows the pressurizing chamber 25 and the low-pressure fuel passage 14 to communicate with each other. When the electromagnetic valve 28 is closed, the electromagnetic valve 28 blocks the communication between the pressurizing chamber 25 and the low-pressure fuel passage 14. When the pressure of the fuel in the pressurizing chamber 25 exceeds a specified discharge pressure, the check valve 29 is opened and allows fuel discharge from the pressurizing chambers 25 to the high-pressure fuel pipes 30A, 30B.

Fuel injection valves 31 for cylinders that are disposed in the respective banks are connected to the respective high-pressure fuel pipes 30A, 30B of the banks (10A, 10B). These fuel injection valves 31 are electromagnetic fuel injection valves for in-cylinder injection that inject the fuel into the cylinders by valve bodies being opened in response to energization. A relief valve 33 is disposed on the high-pressure fuel pipe 30A of the first bank 10A. When the pressure in the high-pressure fuel pipe 30A has a predetermined value or more, the relief valve 33 is opened and returns the fuel in the high-pressure fuel pipe 30A to the fuel tank 13 via a drain passage 34. A fuel pressure sensor 35 that detects the pressure (fuel pressure) of the fuel in the high-pressure fuel pipe 30A is disposed in the high-pressure fuel pipe 30A of the first bank 10A. The high-pressure fuel pipes 30A, 30B of the two banks are connected to each other via a connecting pipe 32. Accordingly, the two high-pressure fuel pipes 30A, 30B function as an integrated fuel pipe in substance.

In the fuel supply device according to this embodiment, the opening and closing of the respective electromagnetic valves 28 of the high-pressure fuel pumps 20A, 20B are controlled by an electronic control unit 36. The electronic control unit 36 is provided with a central processing unit that performs various types of calculation processing, a read-only memory in which a program and data for control are stored, a readable and writable memory that temporarily stores a result of the calculation by the central processing unit, a result of detection by an external sensor, and the like, an input port for receiving a signal from the outside, and an output port for transmitting a signal to the outside.

Various sensors such as the fuel pressure sensor 35, a crank angle sensor 37, an air flow meter 38, and a vehicle speed sensor 39 are connected to the input port of the electronic control unit 36. The electronic control unit 36 calculates and obtains a rotation speed (engine rotation speed NE) and a load (engine load KL) of the internal combustion engine, a traveling speed (vehicle speed SPD) of a vehicle in which the internal combustion engine is mounted, and the like based on detection signals of these sensors.

In the fuel supply device that has the above-described configuration, a fuel pressurizing operation of the high-pressure fuel pumps 20A, 20B is performed as follows. Hereinafter, a movement of the plunger 22 that causes the volume of the pressurizing chamber 25 to expand will be referred to as a fall of the plunger 22, and a movement of the plunger 22 that causes the volume of the pressurizing chamber 25 to shrink will be referred to as a rise of the plunger 22.

During the fall of the plunger 22, the energization of the electromagnetic solenoid 27 is stopped and the electromagnetic valve 28 is open. When the volume of the pressurizing chamber 25 expands with the plunger 22 falling in this state, the fuel that is pumped from the fuel tank 13 by the feed pump 11 is suctioned into the pressurizing chamber 25. Once the plunger 22 rises after falling, the expanded volume of the pressurizing chamber 25 shrinks. If the state where the energization of the electromagnetic solenoid 27 is stopped continues at this time, the suctioned fuel in the pressurizing chamber 25 returns to the low-pressure fuel passage 14 through the open electromagnetic valve 28. When the electromagnetic valve 28 is closed with the energization of the electromagnetic solenoid 27 initiated during the rise of the plunger 22, the pressurizing chamber 25 is put into a state of being sealed from the outside and the pressure of the fuel in the pressurizing chamber 25 rises in response to the shrinkage of the volume of the pressurizing chamber 25. Once the pressure of the fuel in the pressurizing chamber 25 reaches a discharge pressure of the check valve 29, the check valve 29 is opened and the fuel in the pressurizing chamber 25 is discharged toward the high-pressure fuel pipes 30A, 30B. When the plunger 22 falls after rising, the energization of the electromagnetic solenoid 27 is stopped. Then, the fuel is suctioned into the pressurizing chamber 25 again in response to the subsequent fall of the plunger 22.

As described above, the high-pressure fuel pumps 20A, 20B perform the pressurization and discharge of the fuel with the initiation of the fall of the plunger 22 to the termination of the rise of the plunger 22 constituting one operation cycle. In the following description, the period when the plunger 22 is on the fall will be referred to as a "suction stroke" of the high-pressure fuel pumps 20A, 20B, and the period when the plunger 22 is on the rise will be referred to as a "pressurization stroke" of the high-pressure fuel pumps 20A, 20B. In a case where the energization of the electromagnetic solenoid 27 is not performed until the termination of the pressurization stroke, the pressurizing operation of the high-pressure fuel pumps 20A, 20B in that cycle is paused.

The electronic control unit 36 adjusts a fuel discharge amount of the high-pressure fuel pumps 20A, 20B by changing an energization initiation timing of the electromagnetic solenoid 27 (opening timing of the electromagnetic valve 28) in the pressurization stroke. The pressure (fuel pressure) of the fuel that is supplied to the fuel injection valve 31 is controlled through the adjustment of the fuel discharge amount described above. Hereinafter, details of the fuel pressure control will be described.

During the fuel pressure control, first, the electronic control unit 36 sets a target fuel pressure, which is a target value of the fuel pressure, based on the engine load KL and the like. Basically, the target fuel pressure is set to a low pressure at a time of a low load when a required injection quantity is small. Then, the electronic control unit 36 adjusts the energization initiation timing of the electromagnetic solenoid 27 in the pressurization stroke in accordance with a deviation between the target fuel pressure and the value of the fuel pressure detected by the fuel pressure sensor 35 (actual fuel pressure). Specifically, when the actual fuel pressure is lower than the target fuel pressure, the electronic control unit 36 puts forward the energization initiation timing of the electromagnetic solenoid 27 in the pressurization stroke and increases the fuel discharge amount of the high-pressure fuel pumps 20A, 20B. When the actual fuel pressure is higher than the target fuel pressure, the electronic control unit 36 puts off the energization initiation timing of the electromagnetic solenoid 27 in the pressurization stroke and decreases the fuel discharge amount of the high-pressure fuel pumps 20A, 20B.

The two high-pressure fuel pumps 20A, 20B of the first bank 10A and the second bank 10B of the fuel supply device for an internal combustion engine according to this embodiment are an example of a fuel pressurization device.

The electronic control unit 36 adjusts a fuel injection quantity by changing energization time with respect to the fuel injection valve 31. Specifically, the electronic control unit 36 calculates the energization time of the fuel injection valve 31 that is required for the fuel to be injected by a required amount for each injection based on the fuel pressure.

The electromagnetic fuel injection valve 31 with which the fuel supply device according to this embodiment supplies the fuel has a structural lower limit in terms of the injection quantity at which a variation of the injection quantity can be suppressed. The internal combustion engine to which the fuel supply device according to this embodiment is applied employs a partial lift injection technique that allows high-accuracy trace injection surpassing that limit.

Figure 2:
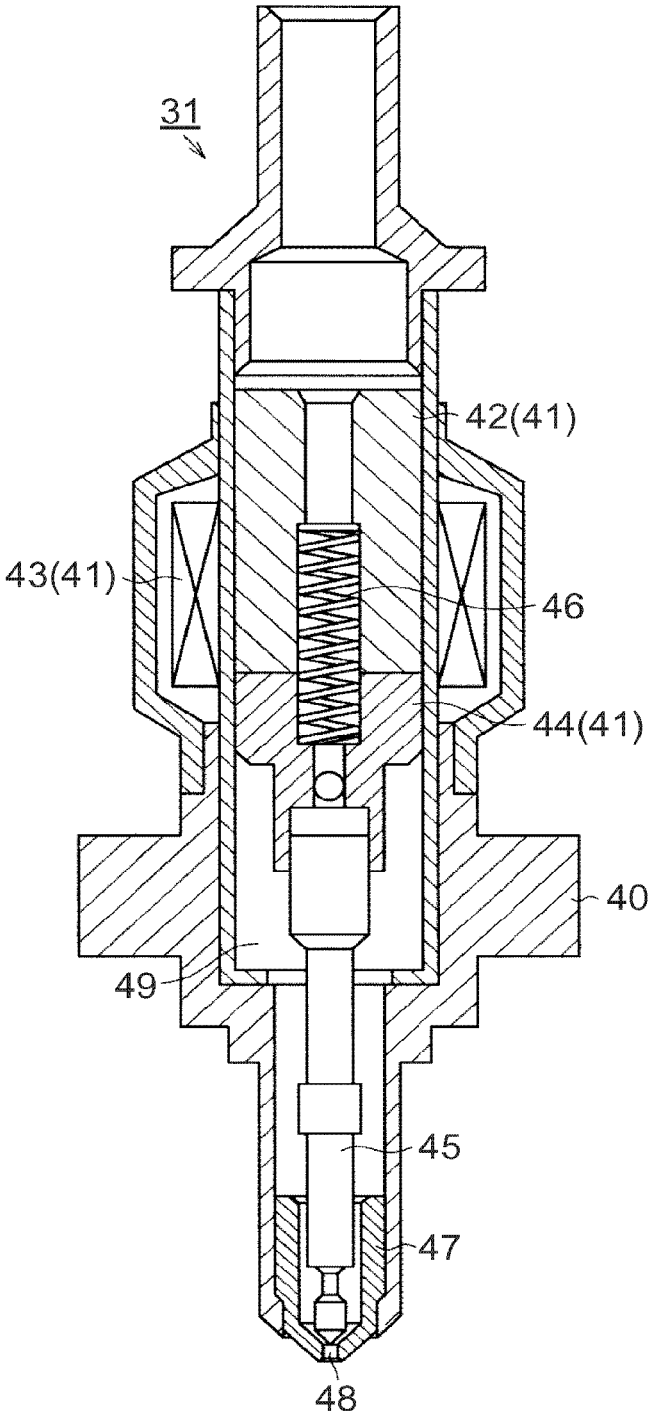
FIG. 2 is a sectional view illustrating a sectional structure of a fuel injection valve of the fuel supply device according to this embodiment.

A sectional structure of the fuel injection valve 31 is illustrated in FIG. 2. As illustrated in FIG. 2, an electromagnetic solenoid 41 is disposed in a housing 40 of the fuel injection valve 31. The electromagnetic solenoid 41 is provided with a fixed core 42, an electromagnetic coil 43, and a movable core 44. The fixed core 42 is fixed to the housing 40. The electromagnetic coil 43 is disposed around the fixed core 42. The movable core 44 is disposed adjacent to the fixed core 42. In the housing 40, the movable core 44 is installed to be capable of being displaced in the vertical direction of FIG. 2. A valve body 45 is integrated with the movable core 44 and is connected to the movable core 44 to be capable of displacement. A spring 46 is disposed in the housing 40 and the spring 46 biases the movable core 44 at all times toward a side of separation from the fixed core 42 (lower side in the drawing). A fuel chamber 49, into which the high-pressure fuel sent from the high-pressure fuel pipes 30A, 30B is introduced, is formed in the housing 40.

A nozzle body 47 is attached to a tip part of the housing 40 (lower end part in the drawing) to surround a tip part of the valve body 45. A slit-shaped injection hole 48 is formed at a tip of the nozzle body 47 so that the inside and outside of the nozzle body 47 communicate with each other.

The valve body 45 of the fuel injection valve 31 is configured to be displaced within a range of a fully closed position at which a tip of the valve body 45 abuts against (is seated on) the nozzle body 47 to a fully open position at which the movable core 44 abuts against the fixed core 42. Once the tip of the valve body 45 is lifted from the nozzle body 47, the injection hole 48 communicates with the fuel chamber 49 and the fuel introduced into the fuel chamber 49 is injected to the outside of the fuel injection valve 31 through the injection hole 48. Once the valve body 45 is displaced to reach the fully closed position and is seated on the nozzle body 47, the communication between the injection hole 48 and the fuel chamber 49 is blocked and the fuel injection is stopped. In the following description, the amount of the displacement of the valve body 45 from the fully closed position will be referred to as a nozzle lift amount.

Figure 3:
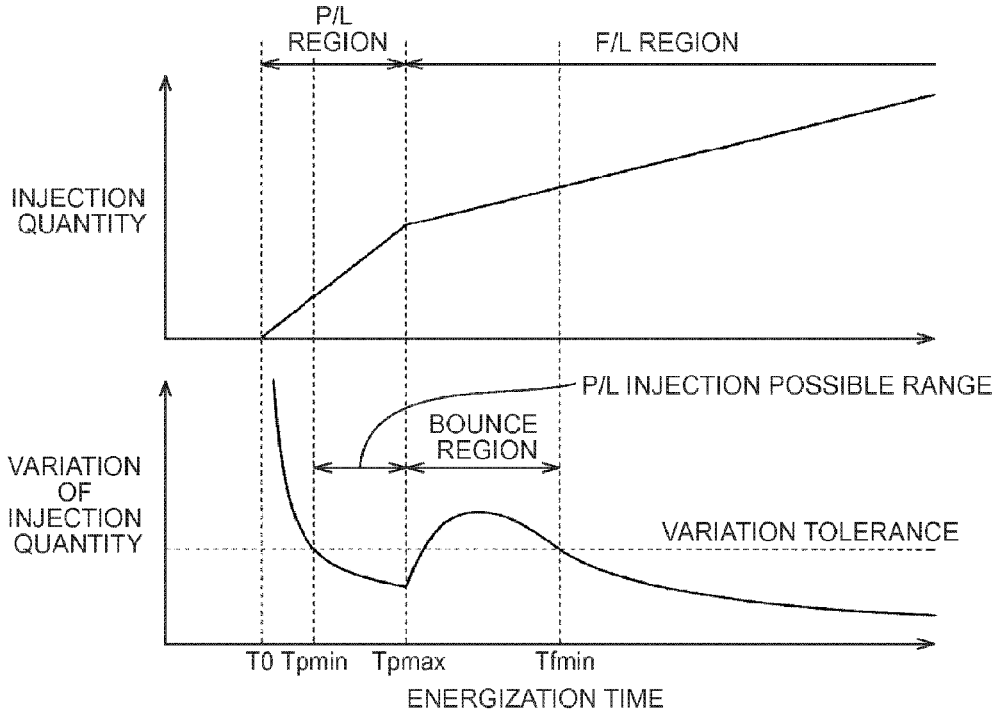
FIG. 3 is a graph illustrating a relationship of an injection quantity and a variation of the injection quantity to energization time with regard to the fuel injection valve of the fuel supply device.

A relationship of the injection quantity of the fuel injection valve 31 and the variation of the injection quantity to energization time of the electromagnetic solenoid 41 is illustrated in FIG. 3. In FIG. 3, "T0" represents energization time that is required for initiating the lifting of the valve body 45 (lift initiation energization time). "Tpmax" represents energization time that is required for the valve body 45 to be lifted to the fully open position (P/L maximum energization time). In the section of T0 to Tpmax, the nozzle lift amount during the energization changes, and thus the rate of change in the fuel injection quantity with respect to the energization time is relatively high. In the section subsequent to the P/L maximum energization time Tpmax, the nozzle lift amount is maintained at an amount at a time of full opening, and thus the rate of change in the fuel injection quantity with respect to the energization time is relatively low. In the following description, the energization time section of T0 to Tpmax in which the valve body 45 does not reach the full opening will be referred to as a "partial lift (P/L) section" while the energization time section subsequent to the Tpmax in which the valve body 45 is fully open will be referred to as a "full lift (F/L) section".

The period that continues until the initiation of the lifting of the valve body 45 after the initiation of the energization is subjected to a certain degree of variation, and this variation results in the variation of the fuel injection quantity in the partial lift section. Still, this variation of the fuel injection quantity in the partial lift section decreases as the energization time increases. Immediately after the energization time enters the full lift section, the variation of the fuel injection quantity is temporarily increased by a bounce motion of the valve body 45 described above. The effect of this bounce motion relatively decreases as the energization time increases. Accordingly, the variation of the fuel injection quantity temporarily increasing immediately after the energization time enters the full lift section decreases as the energization time increases. Accordingly, when the fuel injection is performed with the energization time of the electromagnetic solenoid 41 set to at least a specified time longer than the Tpmax (full lift injection minimum energization time Tfmin), the variation of the fuel injection quantity can be kept at or below an allowed upper limit value.

As described above, the variation of the fuel injection quantity is relatively small, even in the partial lift section, during the energization time immediately before the energization time enters the full lift section. Accordingly, the variation of the fuel injection quantity can be kept at or below the allowed upper limit value by the fuel injection being performed with the energization time of the electromagnetic solenoid 41 set within a range not exceeding the Tpmax but equal to or longer than a specified time (P/L minimum energization time Tpmin). Hereinafter, the energization time range of the Tpmin to the Tpmax will be referred to as a "P/L injection possible range". When the fuel injection is performed in a state where the valve body 45 does not reach the full opening with the energization time set to the P/L injection possible range, which is so-called partial lift injection, the high-accuracy trace fuel injection can be performed.

Figure 4:
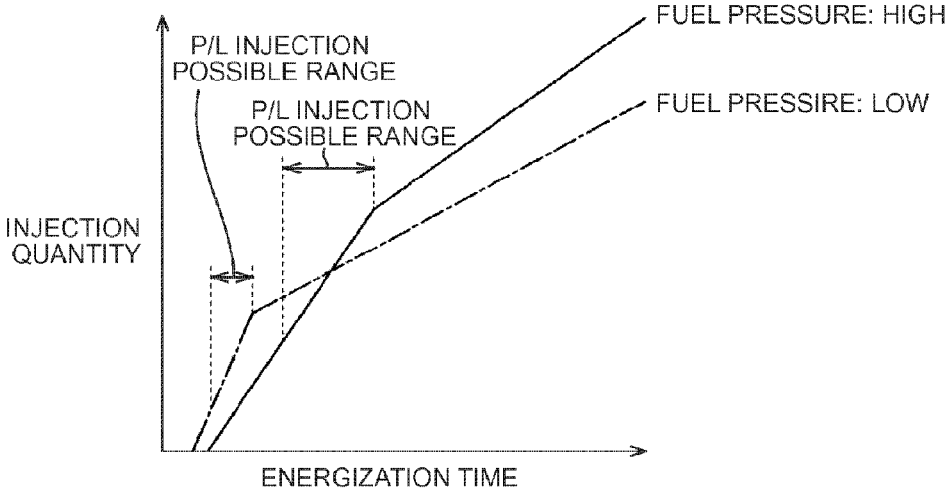
FIG. 4 is a graph illustrating a relationship between the energization time and the injection quantity of the fuel injection valve at a time of a high fuel pressure and a relationship between the energization time and the injection quantity of the fuel injection valve at a time of a low fuel pressure.

Relationships between the injection quantity of the fuel injection valve 31 and the energization time at a time of a high fuel pressure and at a time of a low fuel pressure are illustrated in FIG. 4. The fuel pressure in the fuel chamber 49 is a resistance to the lifting of the valve body 45, and thus the lift initiation energization time T0 increases as the fuel pressure increases and the speed of the lifting of the valve body 45 subsequent to the initiation of the lifting decreases as the fuel pressure increases as illustrated in FIG. 4. Accordingly, the P/L injection possible range in which the variation of the injection quantity can be kept at or below the allowed upper limit value is changed depending on the fuel pressure.

In the internal combustion engine to which the fuel supply device according to this embodiment is applied, the trace fuel injection based on the partial lift injection is performed if needed. During catalyst warm-up for a cold start, for example, the partial lift injection of a trace amount of the fuel is performed during a compression stroke after the full lift injection is performed during an intake stroke. This partial lift injection during the compression stroke improves a combustion state of the internal combustion engine by allowing the fuel concentration of an air-fuel mixture around an ignition plug to be locally increased.

As described above, the two high-pressure fuel pumps 20A, 20B according to this embodiment pressurize the fuel in accordance with the opening and closing of the electromagnetic valve 28 and discharge the fuel toward the fuel injection valve 31. During the pressurizing operation of the high-pressure fuel pumps 20A, 20B, an operation sound that is attributable to the opening and closing of the electromagnetic valve 28 is generated. When a sound that is generated by the internal combustion engine and a traveling sound of the vehicle are not loud in general as in an idle operation of the internal combustion engine and during a low-speed traveling of the vehicle, the operation sound of the electromagnetic valve 28 stands out and a driver might feel uncomfortable with the operation sound. The fuel supply device according to this embodiment carries out an operation sound suppression control for suppressing the operation sound of the electromagnetic valve 28 when a situation in which the driver feels uncomfortable with the operation sound as described above arises.

Figure 5:
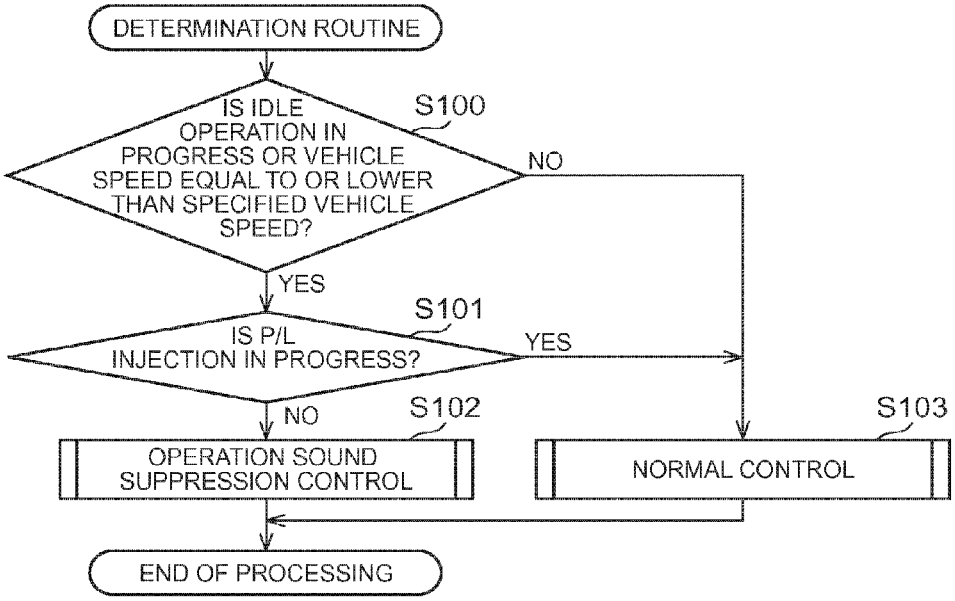
FIG. 5 is a flowchart of an electromagnetic valve control switching routine that is executed in the fuel supply device according to this embodiment.

FIG. 5 shows a flowchart of a determination routine for determining the necessity of the execution of the operation sound suppression control. While the internal combustion engine is in operation, the processing of this determination routine is repeatedly executed by the electronic control unit 36 for each specified control cycle.

In Step S100, which is the first step following the initiation of the processing of this routine, it is determined whether or not the suppression of the operation sound is necessary in the current situation, that is, whether or not the required fuel discharge amount is small and the operation sound of the electromagnetic valve 28 stands out in the current situation. Specifically, it is determined whether or not at least one of two conditions is satisfied, one being the internal combustion engine being in the idle operation and the other being the vehicle speed SPD being equal to or lower than a specified vehicle speed. In the case of a negative determination (NO) herein, the processing proceeds to Step S103. A normal control for the electromagnetic valve 28 is carried out in Step S103, and then the processing of the current cycle of this routine is terminated.

In the case of a positive determination (YES) in Step S100, the processing proceeds to Step S101. In Step S101, it is determined whether or not the partial lift injection (P/L injection) is in progress. If the partial lift injection is in progress (YES), the normal control for the electromagnetic valve 28 is carried out in Step S103 described above, and then the processing of the current cycle of this routine is terminated. If the partial lift injection is not in progress (NO), the operation sound suppression control for the electromagnetic valve 28 is carried out in Step S102, and then the processing of the current cycle of this routine is terminated.

In this embodiment, the operation sound suppression control is carried out on the condition that the partial lift injection is not in progress as described above. The normal control and the operation sound suppression control for the electromagnetic valve 28 are performed as follows.

Figure 6:
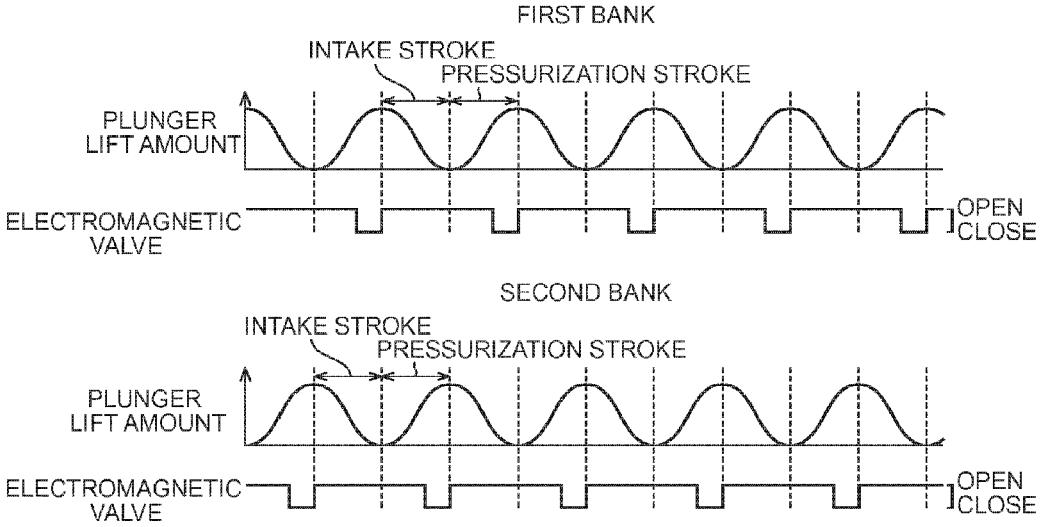
FIG. 6 is a time chart illustrating how respective high-pressure fuel pumps of a first bank and a second bank are operated during a normal control for the fuel supply device according to this embodiment.

During the normal control, an opening and closing control for the electromagnetic valves 28 is performed such that both of the two high-pressure fuel pumps 20A, 20B of the first bank 10A and the second bank 10B perform the pressurizing operation for each operation cycle as illustrated in FIG. 6. In other words, at this time, the energization of the electromagnetic valve 28 is performed for each pressurization stroke in each of the high-pressure fuel pumps 20A, 20B.

Figure 7:
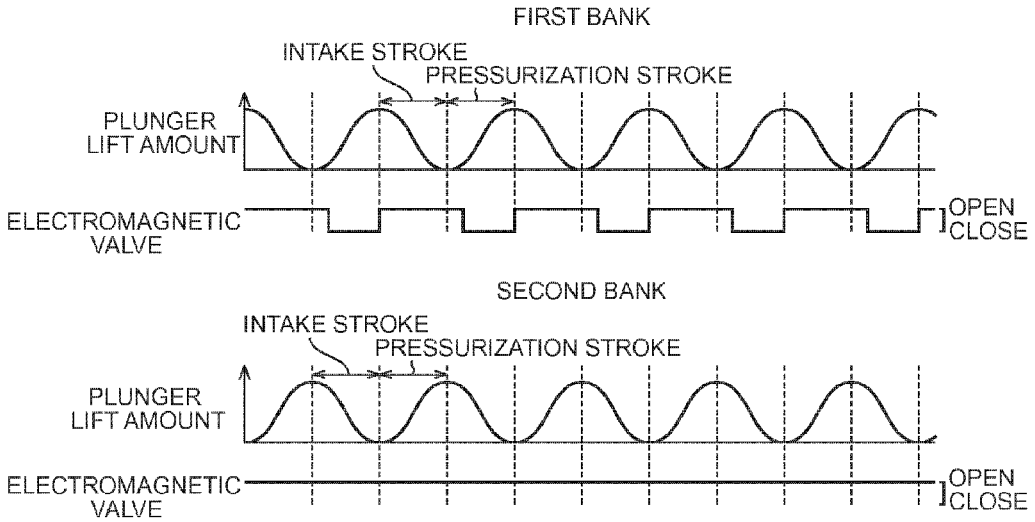
FIG. 7 is a time chart illustrating how the respective high-pressure fuel pumps of the first bank and the second bank are operated during an operation sound suppression control for the fuel supply device according to this embodiment.

During the operation sound suppression control, the opening and closing control for the electromagnetic valves 28 is performed such that the high-pressure fuel pump 20A of the first bank 10A performs the pressurizing operation for each operation cycle whereas the high-pressure fuel pump 20B of the second bank 10B pauses the pressurizing operation as illustrated in FIG. 7. In other words, at this time, the energization of the electromagnetic valve 28 is performed for each pressurization stroke in the high-pressure fuel pump 20A of the first bank 10A whereas the energization of the electromagnetic valve 28 is not performed in the high-pressure fuel pump 20B of the second bank 10B.

As described above, the plunger 22 reciprocates four times per cycle of the internal combustion engine in each of the high-pressure fuel pumps 20A, 20B. In other words, each of the high-pressure fuel pumps 20A, 20B is subjected to four pressurization strokes for each cycle of the internal combustion engine. Accordingly, during the normal control, the fuel discharge is performed eight times in total for each cycle of the internal combustion engine, four from the high-pressure fuel pump 20A and the other four from the high-pressure fuel pump 20B. During the operation sound suppression control, the pressurizing operation of the high-pressure fuel pump 20B of the second bank 10B is paused, and thus the fuel discharge is performed only four times per cycle of the internal combustion engine. Accordingly, during the operation sound suppression control, the amount of the fuel that is discharged by the high-pressure fuel pump 20A of the first bank 10A during the single pressurizing operation is equal to the amount of the fuel discharged twice during the normal control.

An effect of the fuel supply device for an internal combustion engine according to the above-described embodiment will be described below. When the above-described operation sound suppression control is carried out, the opening and closing of the electromagnetic valve 28 of the high-pressure fuel pump 20B of the second bank 10B is paused, and thus an opening and closing frequency of the electromagnetic valves 28 of the entire fuel supply device is half of that during the normal control. Accordingly, the opening and closing frequency of the electromagnetic valves 28 of the entire fuel supply device is reduced and the operation sound attributable to the opening and closing decreases. The fuel pressure pulsation increases because the fuel discharge amount per opening and closing of the electromagnetic valve 28 increases by the same degree as the decrease in the opening and closing frequency of the electromagnetic valves (28).

As described above, the P/L injection possible range is changed depending on the fuel pressure. Accordingly, when the fuel pressure pulsation increases by the operation sound suppression control being carried out while the partial lift injection is carried out, the fuel pressure used for the calculation of the energization time of the electromagnetic solenoid 41 of the fuel injection valve 31 and the fuel pressure during the actual injection deviate from each other and the energization time might deviate from the P/L injection possible range. As a result, the injection quantity accuracy of the partial lift injection might be deteriorated to cause a combustion deterioration. In this regard, in the fuel supply device according to this embodiment, the operation sound suppression control that results in an increase in the fuel pressure pulsation is not carried out while the partial lift injection is in progress.

The following effects can be achieved with the fuel supply device for an internal combustion engine according to this embodiment described above. In this embodiment, the operation sound suppression control that results in an increase in the fuel pressure pulsation is carried out only when the partial lift injection is not in progress. Accordingly, the combustion deterioration can be suppressed and the operation sound of the electromagnetic valve 28 can be suppressed at the same time.

Other embodiments will be described below. In the first embodiment described above, the operation sound suppression control is performed by the pressurizing operation of one of the two high-pressure fuel pumps 20A, 20B of the fuel pressurization device (opening and closing of the electromagnetic valve 28) being paused. The operation sound suppression control, however, can also be performed in a manner different from that of the first embodiment.

Figure 8:
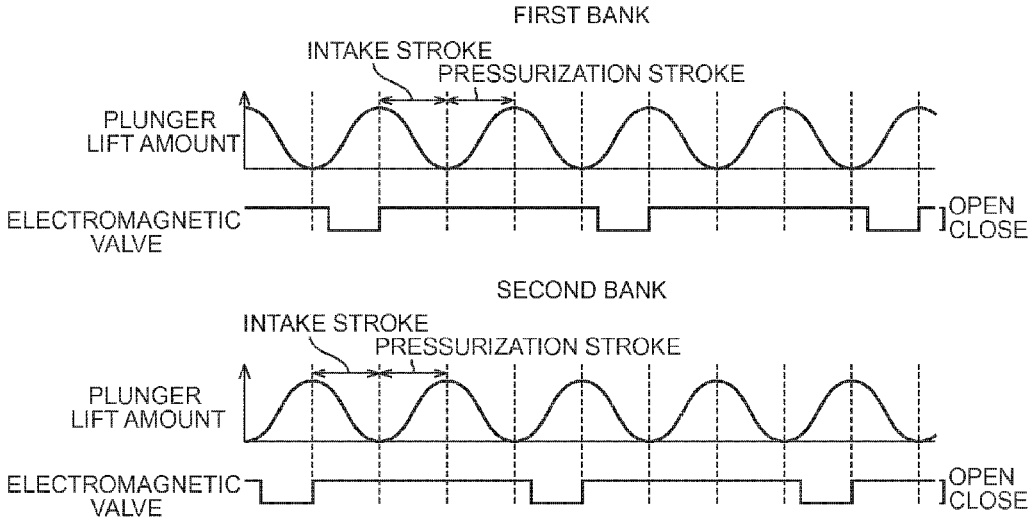
FIG. 8 is a time chart illustrating how respective high-pressure fuel pumps of a first bank and a second bank are operated during an operation sound suppression control for a fuel supply device for an internal combustion engine according to a second embodiment.

A second embodiment will be described below. As illustrated in FIG. 8, in this embodiment, the operation sound suppression control is carried out by the opening and closing control for each of the electromagnetic valves 28 being performed such that each of the two high-pressure fuel pumps 20A, 20B intermittently performs the pressurizing operation. In the case of FIG. 8, the closing of the electromagnetic valve 28 for the fuel discharge is performed during only one of two pressurization strokes in each of the high-pressure fuel pumps 20A, 20B. In other words, during the operation sound suppression control, both the high-pressure fuel pumps 20A, 20B alternately perform the pressurizing operation and the pause of the pressurizing operation for every other operation cycle. Even in this case, the opening and closing frequency of the electromagnetic valves 28 of the entire fuel pressurization device is reduced and the operation sound thereof decreases. Even in this case, the fuel discharge amount per pressurizing operation increases due to the reduction in the opening and closing frequency of the electromagnetic valves 28, and thus the fuel pressure pulsation increases. Accordingly, the combustion deterioration can be suppressed and the operation sound can be suppressed at the same time by the operation sound suppression control not being carried out while the partial lift injection is in progress. This embodiment can be applied to a fuel supply device in which the connecting pipe 32 that connects the high-pressure fuel pipes 30A, 30B of the first bank 10A and the second bank 10B to each other is not disposed, too. In other words, according to this embodiment, the operation sound can be suppressed even in a fuel supply device in which the high-pressure fuel pipes 30A, 30B are configured to be independent of each other.

Figure 9:
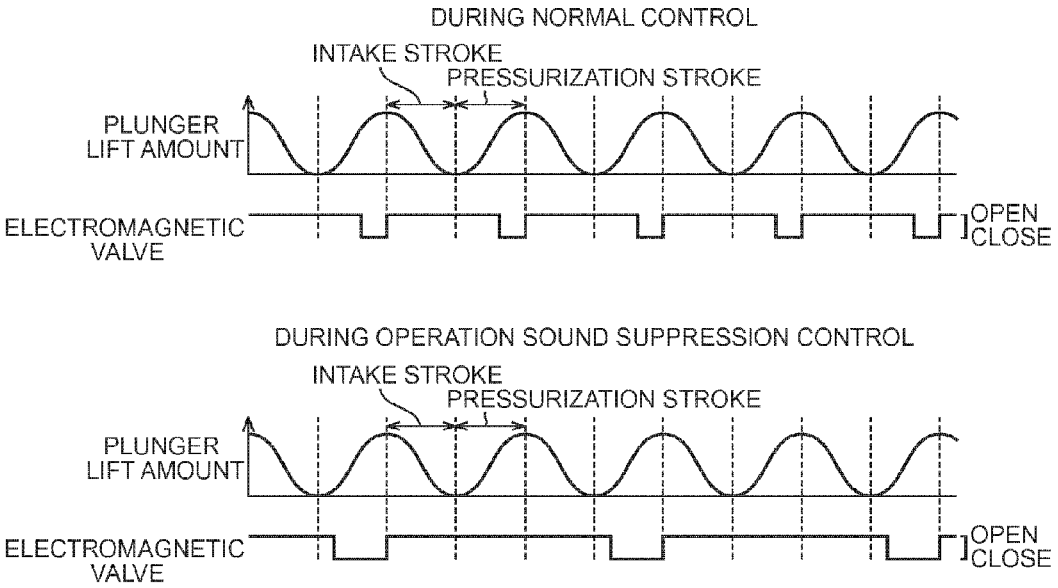
FIG. 9 is a time chart illustrating how a high-pressure fuel pump that is disposed in a fuel supply device for an internal combustion engine according to a third embodiment is operated during a normal control and during an operation sound suppression control.

A third embodiment will be described below. As illustrated in FIG. 9, the operation sound suppression control can be performed even in a fuel supply device for an internal combustion engine in which the fuel pressurization device is provided with only one high-pressure fuel pump. In the example of FIG. 9, the pressurizing operation is performed for each operation cycle during the normal control whereas, during the operation sound suppression control, the opening and closing control for the electromagnetic valve 28 is performed such that the pressurizing operation and the pause of the pressurizing operation are alternately performed for every other operation cycle. Even in this case, the opening and closing frequency of the electromagnetic valves 28 is reduced and the operation sound thereof decreases, but the fuel discharge amount per pressurizing operation increases and the fuel pressure pulsation increases. Accordingly, the combustion deterioration can be suppressed and the operation sound can be suppressed at the same time by the operation sound suppression control not being carried out while the partial lift injection is in progress. Even in this case, the frequency of the pressurizing operation and the pause of the pressurizing operation of the high-pressure fuel pump during the operation sound suppression control can be appropriately changed.

The intermittent operation of the high-pressure fuel pump during the operation sound suppression control may take various forms, examples of which include the pressurizing operation being paused once or twice for every three operation cycles. In a case where a plurality of the high-pressure fuel pumps are disposed in the fuel supply device, in addition, the operation sound suppression control can be performed by the opening and closing of the electromagnetic valves 28 of the respective pumps being controlled such that only some of the plurality of high-pressure fuel pumps are intermittently operated and the rest are operated as usual.

Each of the embodiments described above can be implemented by being modified as follows. In Step S100 of the determination routine regarding the execution of the operation sound suppression control that is illustrated in FIG. 4, the suppression of the operation sound of the electromagnetic valve 28 is determined to be necessary when at least one of the two conditions is satisfied, one being the internal combustion engine being in the idle operation and the other being the vehicle speed SPD being equal to or lower than the specified vehicle speed. The content of the specific condition for the determination may be appropriately changed. In other words, the condition may be any condition that is satisfied when the required fuel discharge amount is small in the current state with the internal combustion engine being in a low-load operation and the operation sound of the electromagnetic valve 28 stands out in the current situation with the sound generated by the internal combustion engine and the traveling sound of the vehicle not loud in general.

What is clamed is:

1. A fuel supply device for an internal combustion engine, the fuel supply device comprising:

a fuel injection valve;

a fuel pressurization device including an electromagnetic valve, the fuel pressurization device being configured to pressurize a fuel in accordance with opening and closing of the electromagnetic valve and discharge the fuel toward the fuel injection valve; and an electronic control unit configured:

to control the opening and closing of the electromagnetic valve such that the amount of the fuel discharged toward the fuel injection valve by the fuel pressurization device is adjusted;

to execute an operation sound suppression control during a low-load operation of the internal combustion engine, the operation sound suppression control being a control for reducing an opening and closing frequency of the electromagnetic valve and increasing the amount of the fuel discharged by the fuel pressurization device for each opening and closing of the electromagnetic valve;

not to execute the operation sound suppression control when a partial lift injection is in progress, the partial lift injection being injection for terminating the fuel injection before a valve body of the fuel injection valve reaches full opening; and to execute the operation sound suppression control when the partial lift injection is not in progress.

2. The fuel supply device according to claim 1, wherein the fuel pressurization device includes a plurality of high-pressure fuel pumps, each of the plurality of high-pressure fuel pumps has the electromagnetic valve respectively, and the electronic control unit is configured to execute the operation sound suppression control by controlling the opening and closing of the electromagnetic valves of the high-pressure fuel pumps such that a part of a pressurizing operation of the high-pressure fuel pumps is stopped.

3. The fuel supply device according to claim 2, further comprising:

a first high-pressure fuel pipe;

a second high-pressure fuel pipe; and a connecting pipe connecting the first high-pressure fuel pipe and the second high-pressure fuel pipe, wherein the internal combustion engine includes a first bank and a second bank, the plurality of high-pressure fuel pumps include a first high-pressure fuel pump and a second high-pressure fuel pump, each of the first high-pressure fuel pump and the second high-pressure fuel pump having the electromagnetic valve, the first high-pressure fuel pump is configured to supply the fuel to the fuel injection valve disposed in the first bank via the first high-pressure fuel pipe, the second high-pressure fuel pump is configured to supply the fuel to the fuel injection valve disposed in the second bank via the second high-pressure fuel pipe, and the electronic control unit is configured to execute the operation sound suppression control such that the pressurizing operation of either the first high-pressure fuel pump or the second high-pressure fuel pump is stopped.

4. The fuel supply device according to claim 1, wherein the fuel pressurization device includes a high-pressure fuel pump, the high-pressure fuel pumps has the electromagnetic valve, and the electronic control unit is configured to execute the operation sound suppression control by controlling the opening and closing of the electromagnetic valve such that pressurizing operations of the high-pressure fuel pump is intermittently executed.

5. A fuel supply method for an internal combustion engine, the internal combustion engine including a fuel pressurization device, a fuel injection valve and an electronic control unit, the fuel pressurization device including an electromagnetic valve, and the fuel pressurization device being configured to pressurize a fuel in accordance with opening and closing of the electromagnetic valve and discharge the fuel toward the fuel injection valve, the fuel supply method comprising:

controlling, by the electronic control unit, the opening and closing of the electromagnetic valve such that the amount of the fuel discharged toward the fuel injection valve by the fuel pressurization device is adjusted;

executing, by the electronic control unit, an operation sound suppression control during a low-load operation of the internal combustion engine, the operation sound suppression control being a control for reducing an opening and closing frequency of the electromagnetic valve and increasing the amount of the fuel discharged by the fuel pressurization device for each opening and closing of the electromagnetic valve;

not executing, by the electronic control unit, the operation sound suppression control when a partial lift injection is in progress, the partial lift injection being injection for terminating the fuel injection before a valve body of the fuel injection valve reaches full opening; and executing, by the electronic control unit, the operation sound suppression control when the partial lift injection is not in progress.

* * * * *